United States Patent [19]

Ikenoue et al.

[11] 3,957,517

[45] May 18, 1976

[54] DRY STABILIZATION OF A SILVER HALIDE PHOTOGRAPHIC MATERIAL

[75] Inventors: Shinpei Ikenoue; Takao Masuda; Masato Satomura, all of Asaka, Japan

[73] Assignee: Fuji Photo Film Co., Ltd., Minami-ashigara, Japan

[22] Filed: Dec. 6, 1973

[21] Appl. No.: 422,386

[30] Foreign Application Priority Data

Dec. 8, 1972 Japan ..... 47-123213

[52] U.S. Cl. ..... 96/61 R; 96/119 PQ

[51] Int. Cl.[2] ..... G03C 5/38

[58] Field of Search ..... 96/61 R, 114.1, 119 PQ, 96/109, 108

[56] References Cited

UNITED STATES PATENTS

| | | | |
|---|---|---|---|
| 2,238,632 | 4/1941 | Dersch | 96/109 |
| 2,288,586 | 6/1942 | Dersch | 96/109 |
| 3,573,055 | 3/1971 | Allentoff | 96/108 |
| 3,594,172 | 7/1971 | Sincius | 96/108 |
| 3,615,510 | 10/1971 | Yudelson et al. | 96/61 R |
| 3,679,422 | 7/1972 | de Mauriac et al. | 96/114.1 |
| 3,692,526 | 9/1972 | Ulbing | 96/114.1 |
| 3,821,001 | 6/1974 | Weber | 96/114.1 |

FOREIGN PATENTS OR APPLICATIONS

| | | | |
|---|---|---|---|
| 1,160,956 | 8/1969 | United Kingdom | 96/108 R |

*Primary Examiner*—Mary F. Kelley

*Attorney, Agent, or Firm*—Sughrue, Rothwell, Mion, Zinn & Macpeak

[57] ABSTRACT

Dry stabilization of a silver halide photographic material, which comprises heating a silver halide photographic material containing silver halide grains at least 50 mol% of which consists of silver bromide to a temperature of at least 80°C. in the presence of 0.1 to 33 mol%, based on the silver halide, of an onium compound having an iodine ion or an anion containing iodine, such as methyltriethylammonium iodide, N-methylpyridinium iodide, or trimethylsulfonium iodide. Preferably, the heating is carried out after the formation of an image on the photographic material.

9 Claims, No Drawings

DRY STABILIZATION OF A SILVER HALIDE PHOTOGRAPHIC MATERIAL

BACKGROUND OF THE INVENTION

1. Field of the Invention

This invention relates to a method for stabilizing a silver halide photographic material in the dry state.

2. Description of the Prior Art

Silver halide photographic materials in general are fixed by dissolving the silver halide with a fixation bath after the formation of an image, and then removing the dissolved silver complex ion by washing with water.

A method for stabilizing a silver halide photographic material intended for shortening the processing time is known. The method comprises converting the silver halide to a silver complex compound devoid of photosensitivity after the formation of an image, without performing washing with water. Specifically, this method is performed by dipping a silver halide photographic material having an image formed thereon in an aqueous solution containing magnesium thiosulfate or thiourea as stabilizer, and then drying the material (see *Photographic Chemistry*, Vol. 1, page 158, Section 149, Fountain Press, 1958). Since, however, this processing is a wet processing by which the photographic material is passed through an aqueous processing bath the photographic material must be dried in the final step. The presence of the drying step is a great defect from the viewpoint of shortening the treating time. Furthermore, the use of a treating liquid causes contamination of things around it or requires control with respect to the preparation or exchanging of the processing liquid. Accordingly, it would be very significant to provide a new dry stabilizing method.

Methods are known in which an image is formed on a silver halide photographic material by a dry treatment such as print-out, thermo-development or photo-development in an attempt to remove the various defects of the wet processing. However, in these methods also, the recorded images cannot be preserved unless they are stabilized, that is to say, unless the discoloration of the non-image area by light is prevented when the processed photographic material is allowed to stand in a bright room. In other words, a method of dry stabilization is required.

One such dry stabilization method is disclosed in U.S. Pat. No. 3,447,927. This method is one in which dry stabilization is carried out imagewise, and is quite different from the dry stabilization method in accordance with this invention. If stabilization is only carried out imagewise, the density of the image area changes progressively when the recorded photographic material stands in a bright place.

In contrast, the dry stabilization method of this invention permits stabilization of both the colored area and the non-colored area of the image at the same time; in other words, it inhibits print-out. Accordingly, the dry stabilization method of this invention is complete in contrast to the dry stabilization method disclosed in U.S. Pat. No. 3,447,927, and this method brings about the same effect in the dry state as the conventional wet stabilization method disclosed in the above-cited *Photographic Chemistry*.

Another conventional dry stabilization method is disclosed in U.S. Pat. No. 3,615,510. This method comprises stabilizing silver halide using a compound selected from the group consisting of organic sulfonium halides, organic sulfoxonium halides, organic ammonium halides, organic phosphonium halides, organic boronium halides, organic siliconium halides, and mixtures of these materials. According to the disclosure of this United States Patent, these compounds are complex salt forming agents for the silver halide, and cations of these compounds play an important role in the formation of complex salts. In order to stabilize the silver halide by dry processing, an image stabilizing layer must be provided by adding such a compound to a low-melting non-aqueous solvent and a polymerizable binder in which the melted solvent can be diffused, and coating the mixture on the silver halide emulsion layer. When the photographic material so produced is heated, the solvent melts and the complex salt forming agent diffuses into the emulsion layer and reacts with the silver halide to thereby stabilize the photographic material.

In order to achieve this object, the manufacturing of the photographic material requires an additional step of providing the image stabilizing layer adjacent the photographic layer. As an alternative procedure, the complex salt forming agent is coated on a developing web, and the photographic material is heated while in contact with it. However, it is advantageous to add the complex forming agent directly to the emulsion before the coating of the stabilizer rather than to provide the stabilizing layer (complex salt forming agent).

When the compound disclosed in U.S. Pat. No. 3,615,510 is used, the addition of the stabilizer to the emulsion is conveniently effected by coating an aqueous solution of the stabilizer at room temperature or at a lower temperature. It is difficult, however, to include the stabilizer in the solidified emulsion layer in the amount required for stabilization. Thus, it is most preferable to add the stabilizer to the emulsion in the molten state, that is, to the emulsion which has been heated to a temperature higher than room temperature to disperse it fully and uniformly into the emulsion, and then coat the mixture on a support.

Furthermore, the amount of the complex salt forming agent should be that required to convert all of the silver halide to an onium halide-silver halide complex salt (a stabilizing amount). Theoretically at least one mole of an onium salt is required per 3 moles of the silver halide, and in actual operation, the onium salt should be used in an amount at least 4 times as large as this theoretical value (at least 4 moles of the onium salt per 3 moles of the silver halide). This is not desirable from the viewpoint of cost.

It is an object of this invention to provide a dry stabilization method for a silver halide photographic material using a small amount of a stabilizer.

Another object of this invention is to provide a dry stabilization method for a silver halide photographic material in which the emulsion layer contains a stabilizer.

Still another object of this invention is to provide a dry stabilizing method which does not require a stabilization promotor such as a non-aqueous solvent.

SUMMARY OF THE INVENTION

It has been found that these objects can be achieved by using as a stabilizer an onium compound having an iodine ion or an anion containing iodine.

According to this invention, there is provided a method for stabilizing a silver halide photographic material in the dry state, which comprises heating a silver halide photographic material containing silver halide grains at least 50 mol% of which consists of silver bromide to a temperature of at least 80°C. in the presence of 0.1 to 33 mol%, based on the silver halide, of an onium compound having an iodine ion or an anion containing iodine.

DETAILED DESCRIPTION OF THE INVENTION

The onium compound which can be used in this invention is defined as a compound containing an element having a lone electron pair, such as oxygen, sulfur or nitrogen, wherein a proton or a cationic reagent is coordinated with the lone electron pair. Specifically, the onium compound is illustrated by the following general formulas.

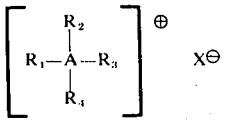

(where A is N, P, As, or Sb)

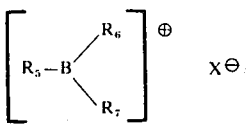

(where B is O, S, SO, Se, or Sn)

$$[R_8 - I - R_9]^{\oplus} X^{\ominus}$$

wherein each of $R_1$ to $R_9$ is carbon-containing substituent, and two R groups (for example, $R_1$ and $R_2$) can be linked to each other to form a ring and X is an iodine ion or a negative ion which contains iodine. As suitable carbon containing substituents, alkyl groups having less than 8 carbon atoms and aryl groups having less than 16 carbon atoms are preferred.

Suitable examples of alkyl groups are a methyl group, an ethyl group, a propyl group, a benzyl group, and a hydroxyethyl group.

Suitable examples of aryl groups are phenyl group, tolyl group, and a naphthyl group.

Preferred examples of rings which are formed by combining two R groups are, a pyridine ring, morpholine ring, an oxazine ring, a thiazine ring, a thiazole ring, an oxazole ring, a benzothiazole ring, and a benzooxazole ring.

Examples of anions containing iodine are a chloroiodide ion ($ICl_2^-$), a bromoiodide ion ($IBr_2^-$), and an iodoion ($I_3^-$). Iodide ion is preferred for X.

Specific examples of onium salts suitable for use in the present invention are:

tetramethylammonium iodide,
ethyltri-n-propylammonium iodide,
methyltriethylammonium iodide,
methyltri-n-butylammonium iodide,
2-hydroxyethyl trimethyl ammonium iodide,
N-lauryl pyridinium iodide,
lauryltrimethylammonium iodide,
phenyltriethylammonium iodide,
N-methylmorpholinium iodide,
N-methylpyridinium iodide,
benzyltrimethylammonium iodide,
N-methyl-N-ethylmorpholinium iodide,
1,2-dimethyl-5-vinylpyridinium iodide, benzyltriphenylphosphonium iodide,
diphenyliodonium iodide,
triethylsulfonium iodide,
trimethylsulfonium iodide,
trimethylsulfoxonium iodide,
triphenylmethylphosphonium iodide,
methyltriphenylarsonium iodide,
tetramethylstibonium iodide,
tetramethyloxonium iodide,
tetramethylselenonium iodide,
tetramethylstannonium iodide,
tetramentylphenylammonium chloroiodide,
tetramentylphenylammonium bromoiodide, and
triphenylbenzylphosphonium chloroiodide.

These compounds are cited merely for illustrative purposes, and it should be noted that the invention is in no way limited to these compounds.

The amount of the onium compound having an iodine ion or an anion containing iodine which can be used is 0.1 to 33 mol%, preferably 0.5 to 25 mol%, based on the silver halide of the photographic material. If the amount of the onium compound is smaller than the specified amount, the photographic material cannot be sufficiently stabilized to light. The use of larger amounts of the onium compound does not bring about an increase in the degree of stabilization, but rather causes a deterioration in the photographic properties of the photographic material, for example, a decrease in sensitivity.

The onium compound can be added at any stage during the production of the emulsion, but is preferably added after physical ripening of the emulsion but before the coating of the emulsion on a support.

It is also possible to incorporate the onium compound into the silver halide emulsion layer using a dipping method. Alternatively, a stabilization layer containing the onium compound can be provided adjacent the silver halide emulsion layer.

The silver halide photographic material having the onium compound incorporated therein is unstable as such to light and when allowed to stand in a bright room, is gradually colored due to the action of the light. Surprisingly, when this photographic material is simply heated, its sensitivity to light is reduced, and even when it is left to stand in a bright room, its coloration by a print-out phenomenon is markedly reduced. This phenomenon can be utilized to replace the fixation or stabilization step that is essential in the processing of silver halide photographic materials by this heating in the presence of the onium compound.

Thus, according to this invention, the processed silver halide photographic material can be stabilized to light by merely heating it in the presence of a small amount of the stabilizer included in the silver halide photographic emulsion layer, without the need for using any stabilization promotor.

The stabilizer used in this invention, when used in an amount of 0.1 to 33 mol% based on the silver halide, is especially effective for a silver halide emulsion at least 50 mol% of which consists of silver bromide, that is, silver bromide, silver chlorobromide, silver iodobromide, and silver chloroiodobromide.

When used in an amount of 0.1 to 33 mol% based on the silver halide, the stabilizer used in this invention is not as effective for silver chloride. This will be shown in the Comparative Example 3 to be given below.

The heating treatment for stabilization is carried out at a temperature of at least 80°C., preferably at least 160°C. for at least 1 second, preferably at least 5 seconds. The upper limit of the heating temperature and the heating time are restricted only by the destruction of the binder for the silver halide or the support as a result of heating, generally at about 270°C for about 60 seconds.

The heating can be carried out using a hot plate, a heated roller, hot air, or infrared rays, etc.

It is not preferred to form images by the wet development method, since the photographic material should be dried before stabilization. The image is preferably formed by the dry method, that is, print-out, photodevelopment, or thermo-development. As stated above, the stabilization treatment by heating is preferably carried out after the formation of images.

If desired, the silver halide emulsion to be used in this invention can further contain a hardening agent such as chromium alum or aldehydes, a surface active agent such as sodium laurylsulfonate, a plasticizer such as glycerol, or a sensitizing dye.

The support of the photographic material can be those conventionally used, for example, baryta paper, synthetic paper-like sheets, water-resistant papers, glass sheets, metal plates, or polymer films such as polyethylene terephthalate film or cellulose acetate films.

The following Examples illustrate the present invention in greater detail. Unless otherwise indicated, all parts and percents are by weight.

EXAMPLE 1

An aqueous solution of silver nitrate and an aqueous solution of potassium bromide were gradually added to an aqueous solution of gelatin being stirred at 60°C. to produce a silver bromide emulsion. The emulsion was coated on a dry plate glass in an amount of 30 mg/100 $cm^2$ caluculated as silver, and dried to form a photographic material (which is designated Sample A). Then, methyltriethylammonium iodide was added to the same emulsion in an amount of 5 mol% based on the silver bromide, and the mixture was coated on a dry plate glass in the same amount calculated as silver as in the preparation of Sample A to form a photographic material (which is designated Sample B).

Two sheets each of Samples A and B were exposed imagewise for 5 minutes using a 20 W fluorescent lamp (illuminance 1500 lux) to form print-out images. Then, each of the Samples A and B was heated by contacting it for 30 seconds with an iron plate heated at 250°C. When these heated Samples A and B and the nonheated imagewise exposed Samples A and B were left to stand under a fluorescent lamp (illuminance 1800 lux), the images on the nonheated Samples A and B and the heated Sample A became obscure due to further print-out throughout these samples. On the other hand, with the heated Sample B, the densities of the colored area and the uncolored area did not change even after standing for 2 hours. When this sample was further allowed to stand in an ordinary bright room for more than 3 weeks, there was hardly any change perceptible to the eye.

EXAMPLE 2

An aqueous solution of silver nitrate, an aqueous solution of potassium bromide and an aqueous solution of potassium chloride were gradually added to an aqueous solution of gelatin which was being stirred at 60°C. to form a silver chlorobromide emulsion (containing 5 mol% of silver chloride).

This emulsion was divided into four portions, and methyltriethylammonium iodide was added in an amount of 2.5 mol%, 5 mol%, 10 mol%, and 20 mol%, respectively, based on the silver chlorobromide. Each of the mixtures obtained was coated on a dry plate glass in an amount of 30 mg/100 $cm^2$ calculated as silver, and dried to form four kinds of samples having different amounts of methyltriethylammonium iodide.

Each of these samples was exposed imagewise for 10 minutes using a 20 W fluorescent lamp (illuminance 1500 lux) to form print-out images, and then contacted for 30 seconds with an iron plate heated at 250°C. These samples were well fixed as in Example 1, and the images were preserved in good condition even when allowed to stand in a bright room.

EXAMPLE 3

Tetramethylammonium iodide was added in an amount of 10 mol%, based on the silver halide, to each of two kinds of silver chlorobromide emulsions for a photographic paper containing 50 mol% and 30 mol% of silver chloride, respectively, two kinds of emulsions for negative use containing 3.5 mol% and 7 mol% of silver iodide respectively, and a silver chloride emulsion for photographic paper. Each of the mixtures obtained was coated on a dry plate glass in an amount of 30 mg/100 $cm^2$ calculated as silver, and then dried to form five samples of photographic material. Each of the samples was exposed imagewise to form print-out images, and then contacted for 30 seconds with an iron plate heated at 250°C. The images were stabilized.

EXAMPLE 4

N-methylpyridinium iodide was added to the same silver bromide emulsion as produced in Example 1 in an amount of 5 mol% based on the silver bromide, and then the mixture was coated on a dry plate glass in an amount of 30 mg/100 $cm^2$ calculated as silver, and dried to form a sample of photographic material. When the sample was exposed imagewise to form a print-out image, and then contacted for 30 seconds with an iron plate heated at 250°C., the image was well stabilized as in the case of Example 1.

The above procedure was repeated except using N-methylmorpholino iodide, tri-n-propylammonium iodide, triphenylsulfoxonium iodide respectively instead of the N-methylpyridinium iodide. When the five samples obtained were imagewise exposed, and then heated in the same manner as described above, the images were well stabilized.

EXAMPLE 5

Tetramethylammonium iodide was added to the same emulsion as prepared in Example 1 in an amount of 5 mol% based on the silver bromide. The mixture was coated on a dry plate glass in an amount of 30 mg/100 $cm^2$ calculated as silver, and dried to form a sample of a photographic material. The sample was exposed imagewise for 5 minutes using a 20 W fluorescent lamp (illuminance 1500 lux) to form a print-out image. The sample was cut into three portions, which were heated by contacting for 40 seconds with an iron plate heated at a temperature of 180°C., 220°C., and 250°C., respectively. The heated samples were well stabilized to light.

Comparative Example 1

Tetramethylammonium bromide was added to the same silver bromide emulsion as prepared in Example 1 in an amount of 5 mol% based on the silver bromide. The mixture was coated on a dry plate glass in an amount of 30 mg/100 $cm^2$ calculated as silver, and then dried to form a sample of a photographic material. The sample was exposed imagewise to form a print-out image, and then contacted for 30 seconds with an iron plate heated at 250°C. The image was not stabilized.

The above procedure was repeated except that tetramethylammonium chloride was used instead of the tetramethylammonium bromide. The image was not stabilized, either.

Comparative Example 2

The silver bromide emulsion prepared Example 1 was divided into two portions, and to each of the portions was added tetramethylammonium iodide in an amount of 50 mol% based on the silver bromide. Each of the mixtures obtained was coated on a dry plate glass in an amount of 30 mg/100 $cm^2$ calculated as silver, and dried to form two samples of photographic material. These samples were stabilized to light from the start, and no visible image could be obtained.

Comparative Example 3

An aqueous solution of silver nitrate and an aqueous solution of potassium chloride were gradually added to an aqueous solution of gelatin being stirred at 60°C. to form a silver chloride emulsion. Methyltriethylammonium iodide was added to this emulsion in an amount of 5 mol% based on the silver chloride. The mixture was coated on a dry plate glass in an amount of 30 mg/100 $cm^2$ calculated as silver, and dried to form a sample of photographic material. The sample was exposed imagewise for 5 minutes using a 20 W fluorescent lamp (illuminance 1500 lux) to form a print-out image. Then, the sample was contacted for 30 seconds with an iron plate heated at 250°C. When this heated sample was allowed to stand for 2 hours under a fluorescent lamp (illuminance 1800 lux), the image was preserved to some extent, but print-out progressed throughout the photographic material to render the image obscure.

While the invention has been described in detail and with reference to specific embodiments thereof, it will be apparent to one skilled in the art that various changes and modifications can be made therein without departing from the spirit and scope thereof.

What is claimed is:

1. A dry method for the stabilization of a print-out silver halide photographic material wherein the silver halide is the image-forming substance, which comprises (1) imagewise exposure of a silver halide photographic emulsion material to form a print-out image, wherein said silver halide photographic emulsion material consists essentially of silver halide grains at least 50 mol% of which consists of silver bromide and 0.1 to 33 mol%, based on the silver halide, of an onium compound having an iodine ion or an anion containing iodine, said onium compound being a member selected from the group consisting of compounds of the formulae

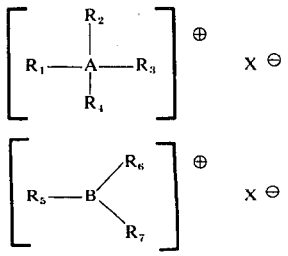

and $$[R_8 - I - R_9]^{\oplus} X^{\ominus}$$

wherein A is N, P, As or Sb, B is O, S, SO, Se or Sn, and each of $R_1$ to $R_9$ is an alkyl group having less than 8 carbon atoms, or an aryl group having less than 16 carbon atoms, or of said $R_1$ to $R_9$ two groups can be connected to each other to form a ring selected from the group consisting of a pyridine ring, a morpholine ring, an oxazine ring, a thiazine ring, a thiazole ring, an oxazole ring, a benzothiazole ring and a benzo-oxazole ring, and wherein X is an iodine ion or an iodine containing anion; and subsequently (2) heating said photographic material to a temperature of at least 80°C, thereby stabilizing said print-out image.

2. The method of claim 1, wherein the amount of said onium compound is 0.5 to 25 mol% based on the silver halide.

3. The method of claim 1, wherein said heating of the photographic material is at a temperature of at least 160°C.

4. The method of claim 1, wherein said heating of the photographic material is for at least 1 second.

5. The method of claim 1, wherein said heating of the photographic material is for at least 5 seconds.

6. The method of claim 1, wherein said onium compound is added after the physical ripening of the silver halide emulsion but before the coating of said emulsion on a support.

7. The method of claim 1, wherein said alkyl group is a methyl group, an ethyl group, a propyl group, a benzyl group or a hydroxyethyl group and said aryl group is a phenyl group, a tolyl group or a naphthyl group.

8. The method of claim 1, wherein said onium compound is tetramethylammonium iodide,
ethyltri-n-propylammonium iodide,
methyltriethylammonium iodide,
methyltri-n-butylammonium iodide,
2-hydroxyethyl trimethyl ammonium iodide,
N-lauryl pyridinium iodide,
lauryltrimethylammonium iodide,
phenyltriethylammonium iodide,
N-methylmorpholinium iodide,
N-methylpyridinium iodide,
benzyltrimethylammonium iodide,
N-methyl-N-ethylmorpholinium iodide,
1,2-dimethyl-5-vinylpyridinium iodide,
benzyltriphenylphosphonium iodide,
diphenyliodonium iodide,
triethylsulfonium iodide,
trimethylsulfonium iodide,
trimethylsulfoxonium iodide,
triphenylmethylphosphonium iodide,
methyltriphenylarsonium iodide,
tetramethylstibonium iodide, tetramethyloxonium iodide,
tetramethylselenonium iodide,
tetramethylstannonium iodide,
tetramethylphenylammonium chloroiodide,
tetramethylphenylammonium bromoiodide, or
triphenylbenzylphosphonium chloroiodide.

9. The method of claim 8, wherein said onium compound is tetramethylphenylammonium chloroiodide, tetramethylphenylammonium bromoiodide or triphenylbenzylphosphonium chloroiodide.

* * * * *